US006196512B1

(12) United States Patent
Ure

(10) Patent No.: US 6,196,512 B1
(45) Date of Patent: Mar. 6, 2001

(54) BOOK STAND

(76) Inventor: Ernesto M. Ure, 2611 Laurel Ave., Manhattan Beach, CA (US) 90266

( * ) Notice: Subject to any disclaimer, the term of this patent is extended or adjusted under 35 U.S.C. 154(b) by 0 days.

(21) Appl. No.: 09/372,187

(22) Filed: Aug. 11, 1999

(51) Int. Cl.[7] ..... A47B 97/04

(52) U.S. Cl. ..... 248/464; 248/44.1; 248/454; 248/455; 248/460; 248/463; D6/419

(58) Field of Search ..... 248/456, 455, 248/454, 441.1, 463, 447, 447.1, 447.2, 460, 462, 464, 465, 451, 457; D06/310, 419, 312, 420; 40/727, 754; 108/44, 45, 47, 134, 135

(56) References Cited

U.S. PATENT DOCUMENTS

| | | | | |
|---|---|---|---|---|
| D. 250,984 | | 2/1979 | Schwartz | D6/419 |
| D. 264,028 | | 4/1982 | Kellogg | D6/310 |
| D. 286,831 | | 11/1986 | Matyear | D6/419 |
| D. 300,092 | | 3/1989 | Middlemist | D6/419 |
| D. 320,319 | | 10/1991 | Brothers et al. | D6/419 |
| D. 321,610 | | 11/1991 | Rienecker | D6/419 |
| D. 344,197 | | 2/1994 | Numbers | D6/419 |
| D. 351,415 | | 10/1994 | Pope | D19/34.3 |
| D. 357,825 | | 5/1995 | Gillam | D6/419 |
| D. 360,777 | | 8/1995 | Glebe | D6/419 |
| D. 361,217 | | 8/1995 | Glebe | D6/419 |
| D. 365,461 | | 12/1995 | Falter | D6/406.4 |
| D. 368,390 | | 4/1996 | James et al. | D6/429 |
| D. 392,474 | | 3/1998 | Frasketi | D6/419 |
| D. 404,931 | | 2/1999 | Duggan | D6/419 |
| D. 404,932 | | 2/1999 | Duggan | D6/419 |
| D. 404,933 | | 2/1999 | Travers | D6/419 |
| 1,216,048 | * | 2/1917 | Bancroft | 248/449 |
| 2,219,091 | * | 10/1940 | Henderson | 248/452 |
| 3,794,284 | | 2/1974 | Guenther | 248/441.1 |
| 3,813,074 | | 5/1974 | Mulvaney | 248/452 |
| 3,950,793 | | 4/1976 | Adams | 4/559 |
| 4,105,182 | | 8/1978 | Jacobson | 248/459 |
| 4,116,413 | | 9/1978 | Andersen | 248/451 |
| 4,258,833 | | 3/1981 | Simms | 190/11 |
| 4,274,616 | | 6/1981 | Radtke | 248/459 |
| 4,294,497 | | 10/1981 | Daniel | 312/231 |
| 4,466,593 | | 8/1984 | Odenath | 248/455 |
| 4,508,306 | | 4/1985 | Kemmerer, Jr. | 248/454 |
| 4,605,193 | | 8/1986 | Kuparinen | 248/460 |
| 4,610,416 | | 9/1986 | Choi | 248/459 |
| 4,618,120 | | 10/1986 | Wattles | 248/460 |
| 4,623,276 | | 11/1986 | Kinneir | 402/80 |
| 4,871,139 | | 10/1989 | Loewke et al. | 248/460 |
| 4,880,327 | | 11/1989 | Sanabria | 402/73 |
| 4,998,703 | | 3/1991 | Stewart | 248/447 |
| 5,016,852 | | 5/1991 | Herendeen | 248/461 |
| 5,085,427 | * | 2/1992 | Finn | 482/148 |
| 5,224,768 | | 7/1993 | Vautier . | |
| 5,413,305 | | 5/1995 | Leeb | 248/460 |
| 5,458,312 | | 10/1995 | Goldberg | 248/441.1 |
| 5,474,356 | | 12/1995 | Johnson | 297/156 |
| 5,564,661 | | 10/1996 | Gershon | 248/167 |
| 5,690,310 | | 11/1997 | Brown | 248/448 |
| 5,720,465 | | 2/1998 | Peltzer et al. | 248/453 |
| 5,772,174 | | 6/1998 | Hirsch et al. | 248/447.1 |
| 5,797,578 | * | 8/1998 | Graffeo et al. | 248/453 |
| 5,810,316 | | 9/1998 | Eby | 248/451 |
| 5,829,729 | | 11/1998 | Welch et al. | 248/441.1 |

* cited by examiner

*Primary Examiner*—Anita M. King
*Assistant Examiner*—Holly Sy
(74) *Attorney, Agent, or Firm*—Lyon & Lyon LLP

(57) ABSTRACT

A portable book stand is adapted for attachment to the back of a pew, bench, chair or similar item, as well as free-standing use on a flat surface such as a table. The book stand may include two separate folding arms attached to the rear surface of a platform on which a book rests. The angle of the platform relative to the reader can be varied by placing the end of one of the folding arms into a selected one of a plurality of grooves in the other folding arm. An attachment arm is used in conjunction with the two folding arms to attach the book stand to the back of a pew, chair, bench or similar support. One folding arm is mounted on a folding assist segment, allowing one folding arm to fold on top of the other without interference.

18 Claims, 2 Drawing Sheets

FIG. 3
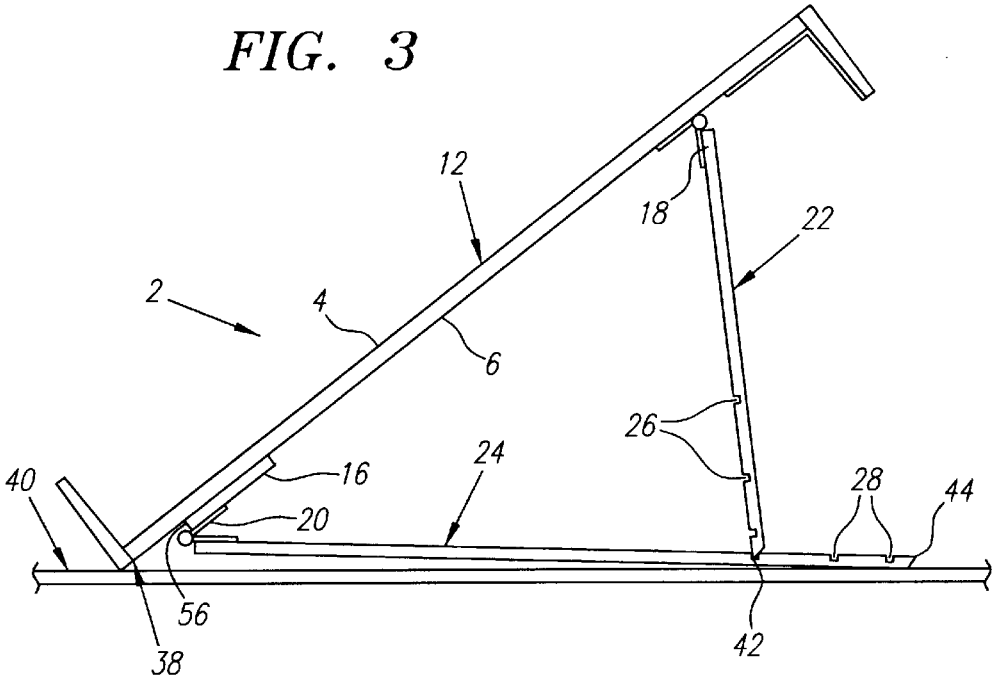
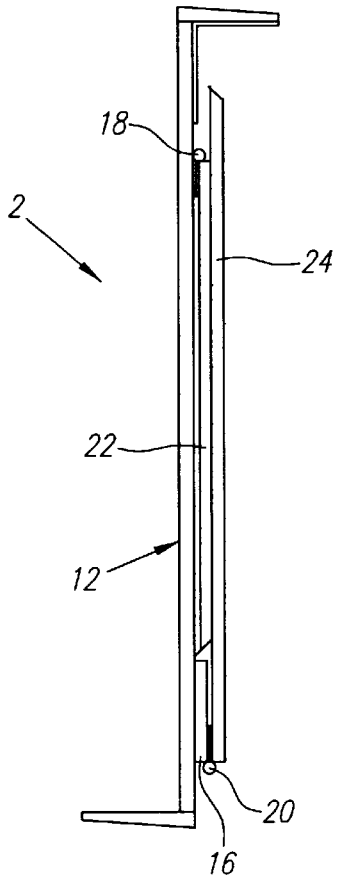
FIG. 4

BOOK STAND

BACKGROUND OF THE INVENTION

The present invention generally relates to the field of book stands, and more particularly to a portable and adjustable book stand that is capable of placement on top of a flat surface or mounting onto various fixtures.

It is often convenient for a reader to set a book down at an angle so that it may easily be read, thereby freeing the reader's hands. It is especially convenient for the elderly and the infirm to be able to read a book without having to hold it, especially if the book is a particularly heavy hardcover volume such as a family bible. Existing book stands are capable of supporting a book at various desired angles. However, existing book stands have several disadvantages, especially for the elderly or the infirm. For example, conventional book stands typically have bulky or complicated mechanisms for holding a book at an angle. Known book stands do not typically fold up into a compact space for transport, or alternatively are too heavy for convenient transport. Traditional book stands may be too difficult for the elderly or infirm to operate. Existing book stands must be used in conjunction with a flat surface capable of bearing a load, such as a table or desk, and are incapable of being easily and conveniently mounted over a fixed item, such as the back of a pew or bench. Thus, people who wish to read in a location where no desks or tables are provided—for example, while seated in a pew in a church—are denied the use of a book stand and are forced to hold the book themselves. However, holding a book, heavy or otherwise, for a prolonged period of time may be inconvenient or impossible for the elderly or infirm. Thus, those who would most benefit from a portable book stand may be deprived of its use.

SUMMARY OF THE INVENTION

The preferred embodiment is directed to a portable book stand. The book stand may include two separate folding arms attached to the rear surface of a platform on which a book rests. The angle of the platform relative to the reader can be varied by placing the end of one of the folding arms into a selected one of a plurality of grooves in the other folding arm. The book stand may also include an attachment arm. The attachment arm may be used in conjunction with the two folding arms to attach the book stand to the back of a pew, chair, bench or similar support. The book stand may also include a folding assist segment on which one folding arm is mounted, allowing one folding arm to fold on top of the other without interference.

BRIEF DESCRIPTION OF THE DRAWINGS

FIG. 3 is a side view of the preferred embodiment.

FIG. 4 is a side view of the preferred embodiment with the folding arms completely folded.

DETAILED DESCRIPTION OF THE PREFERRED EMBODIMENT

Figure 1:
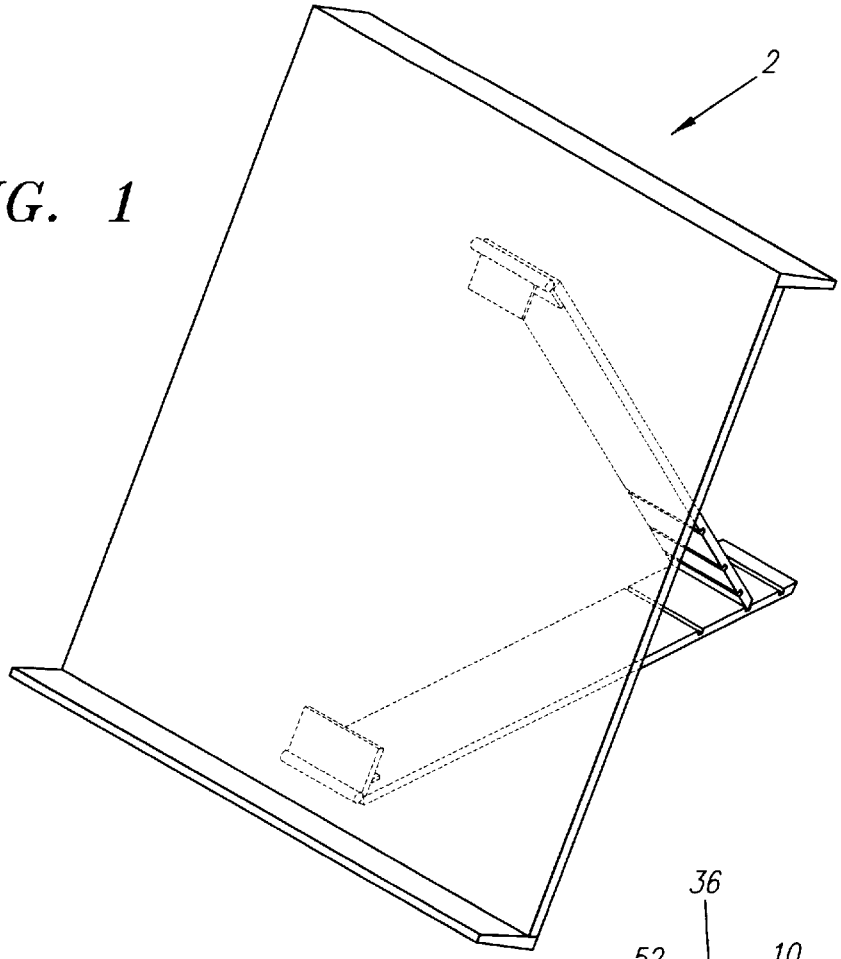
FIG. 1 is a perspective view of a preferred embodiment.
Figure 2:
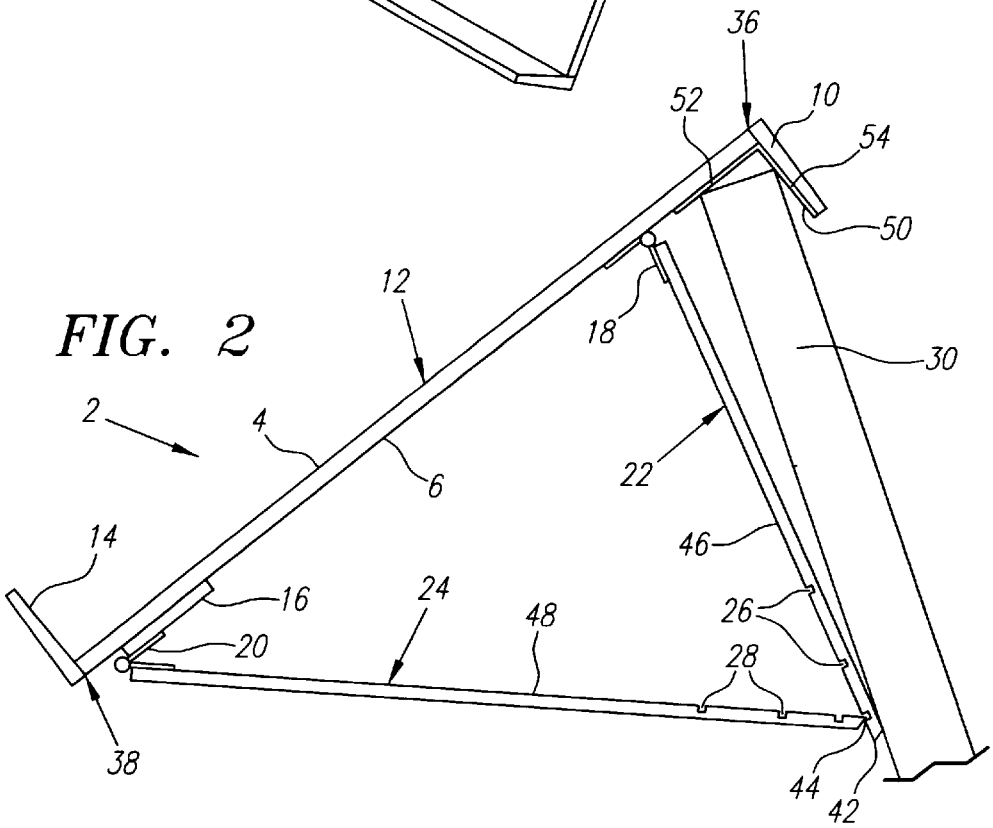
FIG. 2 is a side view of the preferred embodiment attached to the back of a pew.

FIG. 1 shows a perspective view of a preferred embodiment of a book stand 2. Turning to FIG. 2, a side view of the book stand 2 is seen. The book stand 2 has a platform 12, which in a preferred embodiment is substantially flat. The platform 12 has a front surface 4 on which books or other items may be placed, and a rear surface 6. In an aspect of the preferred embodiment, an attachment arm 10 may be attached to a upper end 36 of the platform 12, and extends rearward from the platform 12. Preferably, the attachment arm 10 is attached to the platform 12 such that it does not extend above the level of the front surface 4 of the platform 12, thereby preventing interference with books or materials placed on the front surface 4. The attachment arm 10 preferably extends along the entire width of the platform 12, but the attachment arm 10 need not do so, nor is it prevented from extending further in the lateral dimension than the platform 12. In an alternate embodiment, the attachment arm 10 is not attached to the upper end 36 of the platform 12, but instead is attached to the rear surface 6 of the platform 12 in proximity to its upper end 36. This configuration allows for, among other things, the use of a larger platform 12. A stopping arm 14 may be attached at or near a lower end 38 of the platform 12, and protrudes above the front surface 4 of the platform 12 in order to stop books or other items from sliding off the platform 12 under the influence of gravity. Preferably, the stopping arm 14 extends substantially 0.75 inches above the front surface 4 of the platform 12, which is far enough to stop the vast majority of books from sliding off of the platform 12, but not so far as to protrude inconveniently far when the book stand 2 is in a folded configuration as described below.

As shown in FIG. 2, a first hinge 18 may be attached to the rear surface 6 of the platform 12, closer to the upper end 36 of the platform 12 than to its lower end 38, and substantially centered on the rear surface 6 in the lateral dimension. The distance between the first hinge 18 and the attachment arm 10 varies depending on the thickness of the item, such as a pew back 30, over which the attachment arm 10 is to be placed. When the book stand 2 is built for use with a standard pew back 30, the first hinge 18 can be advantageously located substantially four inches from the attachment arm 10. However, if the pew back 30 or similar object is thicker, the first hinge 18 may be advantageously located further from the attachment arm 10 to provide for secure attachment; conversely, if the pew back 30 or similar object is thinner, the first hinge 18 may be advantageously located closer to the attachment arm 10. Additionally, if the pew back 30 or similar object is inclined backward at an angle, the first hinge 18 may be advantageously located further from the attachment arm 10 as the inclination angle increases to ensure the stability of the book stand 2. The first hinge 18 is also attached to an end of a first folding arm 22, such that the first folding arm 22 is capable of swiveling relative to the platform 12 along an axis that extends substantially parallel to the platform 12 in a substantially lateral direction. The first hinge 18 may be a standard metal hinge, or a strip of durable material such as leather or canvas which allows the first folding arm 22 to move relative to the platform 12 while remaining attached to the platform 12.

As shown in FIG. 2, a folding assist segment 16 is attached to the rear surface 6 of the platform 12, closer to the lower end 38 of the platform than to its upper end 36, and substantially centered on the rear surface 6 in the lateral dimension. The folding assist segment 16 is located on and attached to the rear surface 6 of the platform 12 such that the folding assist segment 16 is in substantially the same lateral position as the first hinge 18. A second hinge 20 is attached to the folding assist segment 16, similarly such that it is in substantially the same lateral position as the first hinge 18. A second folding arm 24 is attached to the second hinge 20, such that the second folding arm 24 is capable of swiveling relative to the platform 12, along an axis that extends substantially parallel to the platform 12 in a substantially lateral direction. The second hinge 20 may be a standard metal hinge, or a strip of durable material such as leather or canvas which allows the second folding arm 24 to move relative to the platform 12 while remaining attached to the platform 12. The first hinge 18 enables the first folding arm 22 to swivel and form various angles with respect to the platform 12. Similarly, the second hinge 20 enables the second folding arm 24 to swivel and form various angles with respect to the platform 12.

One or more first transverse grooves 26 extend across an inside face 46 of the first folding arm 22. Similarly, one or more transverse grooves 28 extend across an inside face 48 of the second folding arm 24. The first transverse grooves 26 are oriented substantially perpendicular to the longitudinal dimension of the first folding arm 22. Similarly, the second transverse grooves 28 are oriented substantially perpendicular to the longitudinal dimension of the second folding arm 24. The first transverse grooves 26 may have any cross-sectional shape, such as but not limited to rectangular, trapezoidal, or triangular, so long as the cross-sectional shape of the first transverse grooves 26 allows a second tip 44 of the second folding arm 24 to fit securely into any selected one of the first transverse grooves 26. Similarly, the second transverse grooves 28 may have any cross-sectional shape, such as but not limited to rectangular, trapezoidal, or triangular, so long as the cross-sectional shape of the second transverse grooves 28 allows a first tip 42 of the first folding arm 22 to fit securely into any selected one of the second transverse grooves 28. The first tip 42 and the second tip 44 each preferably take the shape of a wedge or chisel in cross section, but may possess other shapes capable of fitting securely into the first transverse grooves 26 or the second transverse grooves 28. The first transverse grooves 26 and the second transverse grooves 28 advantageously have a depth of ⅛ inch to ¼ inch.

Turning in greater detail to FIG. 2, the book stand 2 is capable of attachment to an item of furniture having a stable back, such as a pew. When used in conjunction with the pew back 30, the second tip 44 of the second folding arm 24 is inserted into a selected one of the first transverse grooves 26. By placing the second tip 44 of the second folding arm 24 into a selected one of the plurality of first transverse grooves 26 that is closer to the first tip 42 of the first folding arm 22, the platform 12 is oriented at a steeper angle further from horizontal. By placing the second tip 44 of the second folding arm 24 into a selected one of the plurality of first transverse grooves 26 that is further from the first tip 42 of the first folding arm 22, the platform 12 is oriented at a shallower angle closer to horizontal. The user of the book stand 2 thus may select from as many discrete positions of the platform 12 as there are first transverse grooves 26. The use of three or more first transverse grooves 26 allows a user to select from a variety of positions while allowing for simple construction and operation of the book stand 2.

The attachment arm is then placed over the pew back 30, as shown in FIG. 2. The first folding arm 22 and the second folding arm 24, in conjunction with the attachment arm 10, hold the book stand 2 in place against the pew back 30. After the second tip 44 has been placed into one of the one or more first transverse grooves 26, the weight of the book stand 2 presses the second tip 44 into that selected one of the one or more first transverse grooves 26, causing the second tip 44 to lodge securely against the first folding arm 22. The force thus exerted along the second folding arm 24 pushes the first tip 42 of the first folding arm 22 against the pew back 30, assisting in securing the book stand 2 against the pew back 30. The weight of the book stand 2 creates a torque around the first tip 42, which is also transmitted along the second folding arm 24 and also pushes the second tip 44 against the first folding arm 22 to, in turn, push the first tip 42 against the pew back 30. The first folding arm 22 additionally supports the upper end 36 of the platform, and thereby carries weight loads along its own length that also serve to push the first tip 42 against the pew back 30. The attachment arm 10 resists these weight and torque loads at its point of contact with the pew back 30. Such loads tend to pull the attachment arm 10 against the pew back 30, increasing the support provided by the attachment arm 10. Such loads, primarily the torque loads, also tend to pull the book stand 2 up from the pew back 30, but the force exerted against the pew back 30 by the first tip 42 resists such loads, working in conjunction with the attachment arm 10 to attach the book stand 2 to the pew back 30 in a stable fashion. The back surface 6 preferably also contacts the pew back 30, providing some support to the book stand 2 primarily against downward loads resulting from the weight of the book stand 2.

Preferably, an arm pad 50 is attached to the attachment arm 10 on a rear surface 54 of the attachment arm 10 where the attachment arm 10 contacts the pew back 30. The arm pad 50 is composed of a material, such as but not limited to felt, rubber or neoprene, that preferably possesses a coefficient of friction greater than that of the material from which the attachment arm 10 and platform 12 are made and/or the ability to cushion the book stand 2 against the pew back 30 to minimize or prevent damage to the pew back 30. Increased friction from the arm pad 50 helps the book stand 2 to resist torque loads which have the effect of pulling upward on the attachment arm 10 while pulling the attachment arm 10 into the pew back 30. Increased friction from a platform pad 52 attached to the rear surface 6 where the platform 12 contacts the pew back 30 also helps the book stand 2 to resist torque loads which have the effect of pulling the rear surface 6 downward and forward, pulling the rear surface 6 into contact with the pew back 30. The considerations governing the choice of material for an arm pad apply equally to the platform pad 52.

The attachment arm 10 is long enough to prevent the book stand 2 from falling off the pew back under the torque loads generated by the weight of the book stand 2. If the attachment arm 10 is too short, the book stand 2 will slip off of the pew back 30. The attachment arm 10 advantageously extends substantially one and one half inches from the rear surface 6 of the platform 6. However, the attachment arm 10 is preferably manufactured with a longer length if the pew back 30 is thicker or inclined rearward at a steep angle. The attachment arm 10 is preferably substantially normal to the platform 12, but may form other angles with the platform 12 so long as the attachment arm 10 remains capable of resisting downward and torque loads exerted by the book stand 2 when the book stand 2 is placed on the pew back 30.

Referring now to FIG. 3, the book stand 2 is capable of placement on top of a table 40 or other surface so that it may be used as a lectern as well as a book stand. The first tip 42 of the first folding arm 24 fits into a selected one of the second transverse grooves 28 of the second folding arm 24. The first hinge 18 and the second hinge 20 allow the first folding arm 22 to swivel into various positions relative to one another such that the first tip 42 of the first folding arm 44 may be inserted into a selected one of the plurality of second transverse grooves 28 on the second folding arm 24. This allows the platform 12 of the book stand 2 to be elevated to various angles for the user's convenience. By placing the first tip 42 of the first folding arm 22 into a selected one of the plurality of second transverse grooves 28 that is closer to the second tip 44 of the second folding arm 24, the platform 12 is oriented at a shallower angle to horizontal. By placing the first tip 42 of the first folding arm 22 into a selected one of the plurality of second transverse grooves 28 that is further from the second tip 44 of the second folding arm 24, the platform 12 is oriented at a steeper angle to horizontal. The user of the book stand 2 thus may select from as many discrete positions of the platform 12 as there are second transverse grooves 28. The use of three or more first transverse grooves 28 allows a user to select from a variety of positions while simplifying construction and operation of the book stand 2.

The folding assist segment 16 is placed far enough from the lower end 38 of the platform 12 to allow the full length of the stopping arm 14 or lower end 38 to rest on the table 40 or similar flat surface without interference from the second folding arm 24. Advantageously, the folding assist segment 16 is located on the rear surface 6 of the platform 12 such that a lower surface 56 of the folding assist segment 16 is substantially one inch away from the lower end 38 of the platform 12.

Referring now to FIG. 4, a side view depicts the book stand 2 in a collapsed configuration, as may be used for transport or storage. The second hinge 20 is attached to the folding assist segment 16. The folding assist segment 16 and the second hinge 20 together have a thickness greater than or equal to that of the first folding arm 22 and the first hinge 18 combined. After the first folding arm 22 has been folded inward, it is preferably disposed substantially parallel to the platform 12. The folding assist segment 16 displaces the second folding arm 24 relative to the first folding arm 22 such that the second folding arm 24 folds over the first folding arm 22 without interference; that is, the second folding arm 24 is preferably also disposed substantially parallel to the platform 12. Thus, the folding assist segment 16 aids in transport and storage of the book stand 2 in a thin and compact configuration.

While the disclosure describes the attachment of the book stand 2 to the back of the pew 30, the book stand 2 is also capable of attachment to any piece of furniture with a stable back, such as a chair or bench. For example, the book stand 2 could be used in a classroom attached to the back of a chair or bench in front of the user, in an identical manner as disclosed with regard to the back of the pew 30. Further, the book stand 2 is useful in religious ceremonies or observations involving bulky or heavy books in settings where pews are not utilized.

A preferred book stand, and many of its attendant advantages, has thus been disclosed. It will be apparent, however, that various changes may be made in the materials and components without departing from the spirit and scope of the invention, the materials and components hereinbefore described being merely a preferred or exemplary embodiment thereof. Therefore, the invention is not to be restricted or limited except in accordance with the following claims and their legal equivalents.

What is claimed is:

1. A book stand comprising:

a platform having an upper end, a lower end, a front surface and a rear surface;

a first hinge attached to the rear surface of the platform closer to the upper end than the lower end and substantially centered in the lateral dimension;

a first folding arm attached to the first hinge, the first folding arm having a first tip distal from the first hinge, and additionally having an inside face;

one or more first transverse grooves on the inside face of the first folding arm;

a second hinge attached to the rear surface of the platform closer to the lower end than the upper end and substantially centered in the lateral dimension;

a second folding arm attached to the second hinge, the second folding arm having a second tip distal from the second hinge, and additionally having an inside face;

one or more second transverse grooves on the inside face of the second folding arm; and an attachment arm extending rearward from the platform.

2. The book stand of claim 1, wherein the attachment arm is attached to the upper end of the platform.

3. The book stand of claim 1, wherein the attachment arm is attached to the rear surface of the platform in proximity to the upper end.

4. The book stand of claim 1, wherein the first folding arm is attached to the rear surface of the platform substantially four inches from the attachment arm.

5. The book stand of claim 1, wherein the attachment arm extends substantially one and one half inches from the rear surface of the platform.

6. The book stand of claim 1, further comprising a stopping arm extending frontward from the platform.

7. The book stand of claim 6, wherein the stopping arm is attached to the lower end of the platform.

8. The book stand of claim 6, wherein the stopping arm is attached to the front surface of the platform in proximity to the lower end.

9. The book stand of claim 6, wherein the stopping arm protrudes substantially 0.75 inches above the front surface of the platform.

10. The book stand of claim 1, wherein the first transverse grooves and the second transverse grooves are substantially ¼ inch to ⅛ inch deep.

11. The book stand of claim 1, wherein the first tip of the first folding arm defines a wedge adapted to fit into any one of the one or more second transverse grooves.

12. The book stand of claim 1, wherein the second tip of the second folding arm defines a wedge adapted to fit into any one of the one or more first transverse grooves.

13. The book stand of claim 1, further comprising a folding assist segment attached to the rear surface of the platform closer to the lower end than the upper end and substantially centered in the lateral dimension, wherein the second hinge is attached to the folding assist segment.

14. The book stand of claim 13, wherein the combined thickness of the second hinge and the folding assist segment is greater than or equal to the combined thickness of the first folding arm and the first hinge.

15. The book stand of claim 13, wherein the folding assist segment comprises a lower surface, the lower surface being positioned substantially one inch from the lower end of the platform.

16. The book stand of claim 1, further comprising a platform pad attached to the rear surface of the platform in proximity to the upper end and an arm pad attached to a rear surface of the attachment arm.

17. The book stand of claim 16, wherein the platform pad and the arm pad have a coefficient of friction greater than the materials comprising the platform and the attachment arm.

18. A book stand comprising:

a substantially flat platform having an upper end, a lower end, a front surface and a rear surface;

a first hinge attached to the rear surface of the platform closer to the upper end than the lower end and substantially centered in the lateral dimension;

a first folding arm attached to the first hinge, the first folding arm having a first tip distal from the first hinge, and additionally having an inside face;

one or more first transverse grooves on the inside face of the first folding arm;

a folding assist segment attached to the rear surface of the platform closer to the lower end than the upper end and substantially centered in the lateral dimension;

a second hinge attached to the folding assist segment, the combined thickness of the second hinge and the folding assist segment being greater than or equal to the combined thickness of the first folding arm and the first hinge;

a second folding arm attached to the second hinge, the second folding arm having a second tip distal from the second hinge, and additionally having an inside face;

one or more second transverse grooves on the inside face of the second folding arm;

an attachment arm attached to the upper end and extending rearward from the platform;

a stopping arm attached to the front surface of the platform in proximity to the lower end and extending frontward from the platform;

a platform pad attached to the rear surface of the platform in proximity to the upper end and having a coefficient of friction greater than the material comprising the platform; and an arm pad attached to a rear surface of the attachment arm and having a coefficient of friction greater than the material comprising the attachment arm.

* * * * *